US006457797B1

(12) United States Patent
Van Der Meijs et al.

(10) Patent No.: US 6,457,797 B1
(45) Date of Patent: Oct. 1, 2002

(54) INK JET PRINTER AND METHOD OF CONTROLLING THE SAME

(75) Inventors: Hermanus Henricus Van Der Meijs, Venlo; Wilhelmus Peter Johannes Classens, Castenray, both of (NL)

(73) Assignee: Oce TEchnologies B.V., Ma Venlo (NL)

( * ) Notice: Subject to any disclaimer, the term of this patent is extended or adjusted under 35 U.S.C. 154(b) by 0 days.

(21) Appl. No.: 09/995,629

(22) Filed: Nov. 29, 2001

(30) Foreign Application Priority Data

Nov. 29, 2000 (EP) ..... 00204247

(51) Int. Cl.[7] ..... B41J 29/38; B41J 29/393
(52) U.S. Cl. ..... 347/14; 347/19
(58) Field of Search ..... 347/19, 17, 14, 347/37, 23, 5, 9

(56) References Cited

U.S. PATENT DOCUMENTS

| | | | | |
|---|---|---|---|---|
| 4,364,060 A | * | 12/1982 | Jinnai et al. | 347/14 |
| 4,544,931 A | | 10/1985 | Watanabe et al. | 347/17 |
| 5,477,245 A | | 12/1995 | Fuse | 347/10 |
| 5,864,349 A | | 1/1999 | Hirabayashi et al. | 347/39 |
| 6,109,719 A | | 8/2000 | Cornell | 347/14 |
| 6,318,839 B1 | * | 10/2000 | Elgee | 347/37 |

FOREIGN PATENT DOCUMENTS

| | | | |
|---|---|---|---|
| JP | 60-222258 | 11/1985 | B41J/3/04 |
| JP | 10-086405 | 4/1998 | B41J/2/175 |
| JP | 2000-000964 | 1/2000 | B41J/2/01 |

* cited by examiner

*Primary Examiner*—John Barlow
*Assistant Examiner*—Charles W. Stewart, Jr.
(74) *Attorney, Agent, or Firm*—Birch, Stewart, Kolasch & Birch, LLP

(57) ABSTRACT

A method of controlling an ink jet printer including a print head movable relative to a recording medium in a main scanning direction (Y) and having a plurality of nozzles spaced apart from each other in said main scanning direction and being energized at controlled timings for expelling ink droplets onto the recording medium, wherein the method includes the steps of:

measuring at least one parameter, e. g. a temperature, that is correlated to the thermal expansion of the print head, determining, for each of the nozzles, a thermally induced positional offset (Δd1 . . . Δdn) in the main scanning direction on the basis of said parameter, and compensating for the offsets of the individual nozzles by controlling the timings at which the nozzles are energized.

10 Claims, 3 Drawing Sheets

INK JET PRINTER AND METHOD OF CONTROLLING THE SAME

BACKGROUND OF THE INVENTION

The present invention relates generally to ink jet printing and more particularly to ink jet color printing.

A typical ink jet color printer has a print head which is movable back and forth relative to a recording medium, e.g. a sheet of paper, in a main scanning direction. A plurality of nozzle arrays, at least one for each color, are mounted on the print head side-by-side in the main scanning direction. Each nozzle array has a plurality of nozzles arranged in one or more rows which extend in a sub-scanning direction in which the recording sheet is fed past the print head, i.e. a direction orthogonal to the main scanning direction. In order to print an image on the recording sheet, ink droplets are expelled from the various nozzles, so that dots (pixels) are formed on the recording sheet. The positions of the dots formed on the recording sheet depend on the mechanical structure of the print head. Further, the position in the main scanning direction depends on the timings at which the nozzles are energized during the continuous movement of the print head, whereas the positions in the sub-scanning direction depend on the feed distance over which the recording sheet is fed after each scan pass of the print head.

In order to obtain an artifact-free printed image of high quality, it is necessary that the dots are formed on the recording sheet with high positional accuracy. This is particularly the case in a color printer, because colored seams would be visible in the printed image if the positions of the dots of different colors, which are formed by different nozzle arrays, were not adjusted correctly. In addition, even in a mono-color printer, positional deviations of the dots in the sub-scanning direction would result in the occurrence thin lines with reduced or increased image density which separate the image areas that are formed during subsequent scan passes of the print head.

In a so-called bubble-jet printer, the ink droplets are formed by heating the liquid ink, so that part of the ink is evaporated abruptly and creates a pressure which causes an ink droplet to be expelled from the nozzle. In a so-called hot melt ink jet printer, the ink is solid at room temperature and has to be heated above its melting point when the printer is operating. In this type of printer, the pressure for expelling the ink droplets is typically created by means of piezoelectric actuators. In any case, the print head will be subject to temperature changes, and these temperature changes will influence the operating conditions of the print head.

U.S. Pat. No. 5,864,349 discloses an ink jet printer in which a temperature sensor is mounted on the print head for monitoring the operating conditions of the print head. U.S. Pat. No. 4,544,931 and U.S. Pat. No. 5,477,245 disclose ink jet printers in which the signal of a temperature sensor mounted on the print head is used for controlling the frequency or pulse width of pulses with which the nozzles of the print head are energized. JP-A-60 222 258 discloses an ink jet printer in which a print skew detector is mounted outside of the margin of the recording sheet, and the print head is controlled to print dots on this detector during both the forward and the return scan pass of the print head. By comparing the positions of the dots formed in the forward and return scan passes, the detector monitors the effect of a skew of the ink droplets which is caused by the movement of the print head. When, due to temperature and moisture, any change in the conditions of the nozzles and the print head carriage leads to a positional deviation of the dots formed in the forward and return strokes of the print head, the detector will indicate these deviations and will cause the control system of the printer to perform an appropriate correction.

SUMMARY OF THE INVENTION

It is an object of the present invention to reduce the influence of the temperature of the print head on the positional accuracy of dot formation without any need for complex detection systems. According to the present invention, this object is achieved by a method of controlling the ink jet printer.

The invention is based on the consideration that the influence of the temperature of the print head on the positions where the dots are formed on the recording medium is mainly due to thermal expansion of the print head. According to the general concept of the invention, at least one temperature sensor on the print head is used for monitoring the temperature of the print head or the temperature distribution within the print head, so as to predict the effect of thermal expansion of the print head on the nozzle positions on the basis of the known thermal expansion behavior of the print head. Then, the predicted thermally induced positional offsets of the nozzles are compensated for by an appropriate control of the printer. Thus, it is sufficient to provide one or more temperature sensors for making the printer more robust against temperature changes of the print head and for improving the positional accuracy in the dot formation.

In general, the print head will undergo thermal expansion in all three dimensions and, as a result, the positions of the nozzles may be offset in the sub-scanning direction (X-direction), the main scanning direction (Y-direction) and also in a direction normal to the plane of the recording medium (Z-direction). Even an offset in the Z-direction may influence the positions of the dots, because it influences the distance between the nozzle and the recording medium and hence the time of flight of the ink droplets. Since, due to the movement of the print head, the ink droplets have a velocity component in the main scanning direction (skew), an offset in the nozzle position in the Z-direction will lead to an offset in the dot position in the Y-direction. As the print head moves in the Y-direction, the deviations of the dot position in this Y-direction caused by nozzle offsets in the Y- and Z-directions can be compensated for by appropriately correcting the timings at which the nozzles are energized.

Offsets of the nozzle positions in the X-direction can be compensated for by appropriately correcting the feed distance of the recording medium. More specifically, when a nozzle array has a row of nozzles extending in the X-direction, the feed distance of the recording sheet between two subsequent scan passes of the print head must be equal to the distance between the first and the last nozzle of the row plus the distance between two immediately adjacent nozzles of the row. Since these distances, especially the comparatively large distance between the first and the last nozzle, may vary in response to temperature changes, the feed distance of the recording sheet should be adapted accordingly.

In addition, depending on the structure of the print head, thermal expansion of the mounting structure of the print head may also cause a shift of the nozzle array, as a whole, in the X-direction. As long as the temperature is essentially constant over the time which is needed for printing one page, this shift will only lead to a minor shift of the printed image as a whole on the recording sheet and may be neglected. If, however, substantial temperature changes occur between two printing operations in immediately adjacent or overlapping image areas, then this total shift of the nozzle array should be compensated for as well.

It will generally depend upon the structure of the print head and its mounting structure and on the required level of accuracy as to whether the nozzle offsets in all three directions, X, Y and Z or only selected ones of these offsets need to be compensated for.

The term "temperature sensor", as used in the description given above, should be interpreted in a broad sense. More precisely, what actually needs to be measured is a parameter that is correlated to the thermal expansion of the print head and thus permits a determination of the thermally induced offsets of the nozzle positions. In many known temperature sensors, the principle of temperature measurement is itself based on the measurement of the thermal expansion of a medium whose thermal expansion coefficient is known. Thus, it is also possible, according to the present invention, to measure the temperature-dependent distance between two predetermined points on the print head and to take this distance as a parameter which implicitly indicates the temperature of the print head and thereby permits a determination of the thermally induced positional offsets of the various nozzles.

In a preferred embodiment, a predetermined point on the print head is taken as a reference position in the Y-direction, and the absolute position of this point is directly measured with a linear encoder. Then, the Y-positions of the various nozzles are given as temperature-dependent distances between the nozzles and the reference position.

To determine the positions of the nozzles in X- and Z-directions, the print head may be mounted slidably on a guide rail which defines a fixed reference position in the X- and Z-directions, so that the X- and Z-coordinates of the nozzles can again be given by temperature-dependent distances to the respective reference positions.

If the temperature of the print head as a whole can be assumed to be uniform and if the structure of the print head which determines the thermal expansion behavior is made of only a single material, e.g. aluminum, the temperature may be measured with a single temperature sensor, and the temperature-dependent relative positions of the nozzles may be calculated from the known thermal expansion coefficient of this material. On the other hand, if the print head is composed of different materials, then the different thermal expansion coefficients of these materials may be taken into account in the calculation. As an alternative, it is possible to measure the relative positions of the nozzles at different temperatures in advance and to store the results in a look-up table in the control system of the printer.

If it is expected that the temperature of the print head will, in operation, be non-uniform, then it is possible to employ a plurality of the temperature sensors, so that the temperature distribution within the print head can be determined with sufficient accuracy by interpolation techniques, and the local thermal expansions can be calculated on the basis of this temperature distribution.

BRIEF DESCRIPTION OF THE DRAWINGS

Preferred embodiments of the present invention will now be described in conjunction with the accompanying drawings, in which.

DETAILED DESCRIPTION OF THE INVENTION

Figure 1:
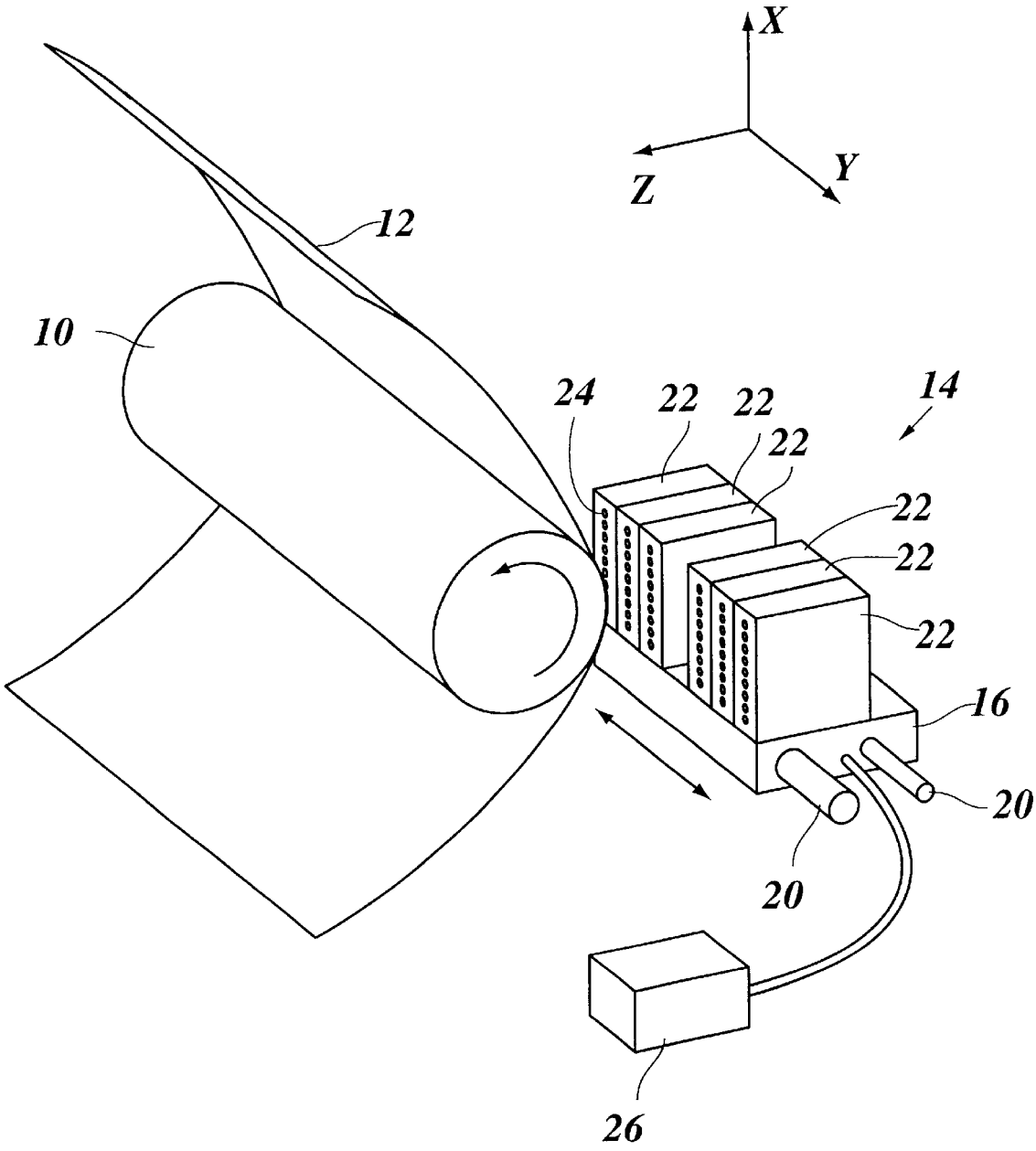
FIG. 1 is a schematic perspective view of an ink jet color printer to which the invention is applicable.

As is shown in FIG. 1, an ink jet color printer comprises a platen 10 on which a recording sheet 12 is advanced in a sub-scanning direction X. A print head 14 is moved back and forth along the platen 10 in a main scanning direction Y and comprises a carriage 16 mounted on guide bares 18, 20 and carries a number of nozzle arrays 22, at least one for each color, which are arranged in the main-scanning direction Y. Each nozzle array comprises a number of nozzles 24 which, in the example shown, are arranged on a single straight line extending in the sub-scanning direction X. The pitch of the nozzles 24, i.e. the vertical distance of neighboring nozzles, corresponds to the height of the pixels to be printed on the recording sheet 12. These pixels are printed by ejecting droplets of colored ink from the nozzles 24 in a direction Z normal to the plane of the recording sheet 12 where it faces the print head. As is well known in the art, the droplets may be generated by means of thermal actuators (bubble-jet) or by means of piezoelectric actuators, for example.

When the print head 14 makes a forward scan pass in the +Y-direction, a number of image lines is printed simultaneously on the recording sheet 12. Then, the recording sheet 12 is advanced by a distance corresponding to the height of the nozzle arrays plus a single pitch, and another group of lines is printed during the return scan pass of the print head 14.

The print head 14 is connected to a control unit 26 which controls the actuators for the various nozzles 24 in accordance with the image information of the image to be printed. The control unit 26 also controls the platen 10 for feeding the recording sheet 12.

Figure 2:
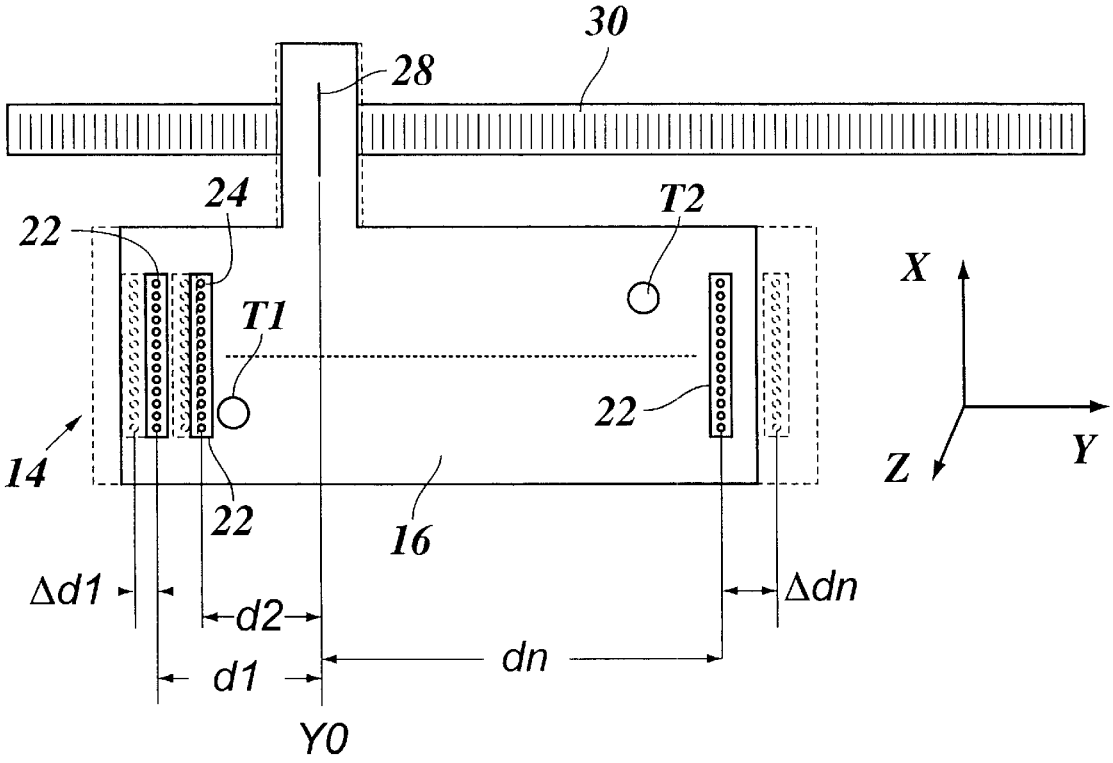
FIG. 2 is a diagrammatic front view of a print head for explaining the method according to the present invention.

As is shown in FIG. 2, the carriage 16 of the print head 14 has a reference mark 28 which defines a fixed reference position Y0 for the Y coordinates of the nozzles 24 of all nozzle arrays 22. The absolute position of the reference mark 28 in the printer is detected by means of a linear encoder 30.

The temperature of the carriage 16, which may be considered to be a plate or frame of aluminum, is measured in two positions by means of temperature sensors T1 and T2. The signals of these temperature sensors are transmitted to the control unit 26 and may be averaged in order to obtain the overall temperature of the print head 14. As an alternative, the two temperature signals may be evaluated separately, one for each half of the carriage 16. At a given standard temperature, the nozzle positions of the nozzle arrays 22 relative to the reference position Y0 are given by the values d1, d2, . . . , dn. When the temperature of the print head is increased, the print head, mainly the carriage 16, will undergo thermal expansion, as is indicated in broken lines in FIG. 2. As a result, the nozzles positions of each nozzle array 22 are shifted by a thermally induced offset Δd1, . . . , Δdn. In the control unit 26, these offsets are calculated on the basis of the measured temperature and the known thermal expansion coefficient of aluminum. When these offsets are divided by the known scanning speed of the print head 14 in the Y-direction, one obtains, for each nozzle array 22, a correction time by which the timings for energizing the nozzles must be delayed or advanced in order to compensate for the thermal expansion of the print head. As a result, ink dots of different color, which are generated by the different nozzle arrays 22, may be superposed directly one upon the other, or, more generally, the positional relationship between the dots may be preserved, irrespective of any temperature changes of the print head. If the offsets are larger than (integer times) the distance between two pixels on the recording sheet in the main scanning direction, then, in a preferred embodiment, the delay or advancement of the timings is carried out only to compensate that part of the offsets that is larger than this distance. The part of the offset that is exactly the same as (integer times) the distance between two pixels is in this embodiment carried out by displacing the print head over this distance. In this way, the actual timing delay or advancement is only used for compensating the small deviations in between the pixels, which is a further improvement of the method according to the present invention.

Figure 3:
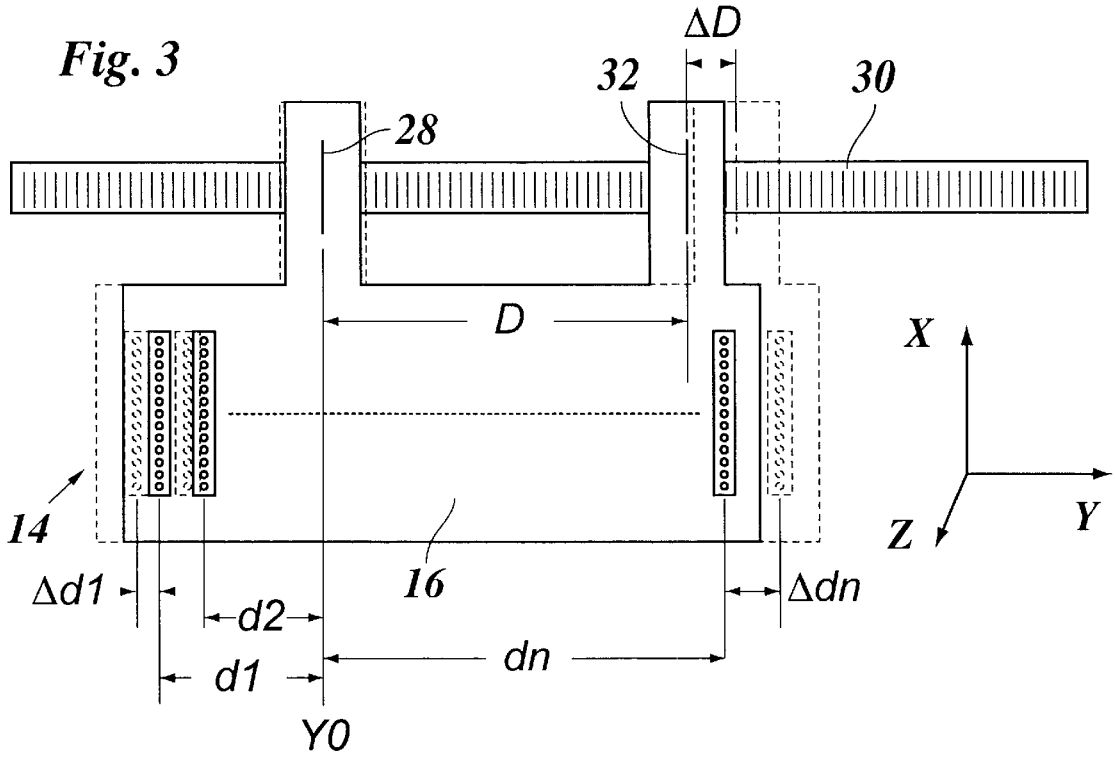
FIG. 3 is a diagrammatic front view of a print head according to a modified embodiment of the present invention.

FIG. 3 illustrates an embodiment in which the print head 14 is not provided with any temperature sensors but, instead, a second reference mark 32 is provided on the carriage 16. The position of the second reference mark 32 can also be measured by means of the linear encoding 30. At standard temperature, the distance between the reference marks 28 and 32 is D. Thermal expansion leads to a change of this distance by a value ΔD which can exactly be measured with the linear encoding. If desired, the temperature of the carriage 16 (which is assumed to be uniform in this case) can be calculated by dividing the ratio ΔD/D through the thermal expansion coefficient. However, the offsets Δd1 . . . Δdi . . . Δdn for each nozzle array 22 can directly be obtained according to the formula:

$$\Delta di = di.\ \Delta D/D$$

While only the effect of thermal expansion in the main scanning direction Y has been considered in the embodiments discussed above, FIG. 4 exemplifies the effects of thermal expansions in the directions X and Z. In the embodiment shown in FIG. 4, a print head 34 has a carriage 36 which is slidably mounted on a single guide rail 38 which extends in the main scanning direction Y. The central axis of the guide rail 38 defines a fixed referenced position X0 for the sub-scanning direction X and a fixed reference position Z0 for the Z-direction in which the ink droplets are expelled.

The carriage 36 has two support bars 40, 42, and the nozzle arrays 22 (only one of which is visible in FIG. 4) are held between these support bars by means of mounting frames 44. Each mounting frame is held on the support bars 40, 42 with positioning pins 46, 48 which engage into positioning holes of the support bars 40, 42, respectively.

It is assumed here that the material of the nozzle arrays 22 is different from that of the carriage 36, so that these components may undergo differential thermal expansion. This is why only the positioning pin 46 is fitted into the corresponding positioning hole without play, whereas the positioning pin 48 is received in an elongated positioning hole of the support bar 42 so that it has a little play in the X-direction. The nozzles of the nozzle arrays 22 are not visible in FIG. 4, but the positions of the first nozzle a and the last nozzle b of the row of nozzles are indicated in the drawing. The temperatures of the nozzle arrays 22 are monitored by means of temperature sensors T3. A separate temperature sensor may be provided for each nozzle array, and the measured temperatures may be averaged. Another temperature sensor T1 detects the temperature of the carriage 36.

The free end of the carriage 36 may be guided by an auxiliary guide rail 50, which, however, does not restrain the thermal expansion of the carriage.

The recording sheet 12 is, in this embodiment, passed over two feed rollers 52 so that the printing region is held in parallel with the front face of the nozzle arrays 22. This assures that the ink droplets expelled from the various nozzles all have to travel the same distance until they impinge on the recording sheet 12.

The effect of thermal expansion of the carriage 36 and the nozzle arrays 22 is again indicated by broken lines. It can be seen that the thermal expansion of the carriage 36, mainly of the support bars 40, 42, in the Z-direction leads to an offset Δz in the distance between the front face of the nozzle arrays 22 and the recording sheet 12. Dividing this offset Δz by the known velocity of the ink droplets in the Z-direction gives a change At in the time of flight of the ink droplets. Since the print head .34 is moved in the main scanning direction Y when the ink droplets are ejected, the ink droplets also have a velocity component in the Y-direction, and this would give rise to a deviation in the Y-position of the dots formed on the recording sheet. In order to compensate for this effect, the energizing timings for the nozzles must be delayed by the time Δt. The offset Δz can be calculated from the distance between the nozzles and the reference position $Z_0$ at standard temperature, the temperature measured by the temperature sensor T1 and the known thermal expansion coefficient of the carriage 36.

The thermal expansion of the carriage and the nozzle arrays in the sub-scanning direction X influences the feed distance F over which the recording sheet 12 must be fed between two subsequent scan passes of the print head.

At standard temperature, the height of the nozzle array 22, i.e. the distance between the first nozzle a and the last nozzle b is H0. If it is assumed that the nozzle array has N nozzles arranged in a single row and the pitch of the nozzles, i.e. the distance between two adjacent nozzles is p, then: H0=(N−1) p. Thus, in order to obtain equidistant lines of printed pixels on the recording sheet 12, the sheet must be fed in the X-direction over a feed distance F=N.p=N H0/(N−1). However, if the nozzle array 22 has undergone thermal expansion and the distance between the nozzles a and b has changed to H1 (offset+H1−H0), then the feed distance is F=N H1/(N−1). H1 can be calculated from the height H0 at standard temperature, the temperature measured with the temperature sensor T3 and the thermal expansion coefficient of the nozzle array 22.

Figure 4:
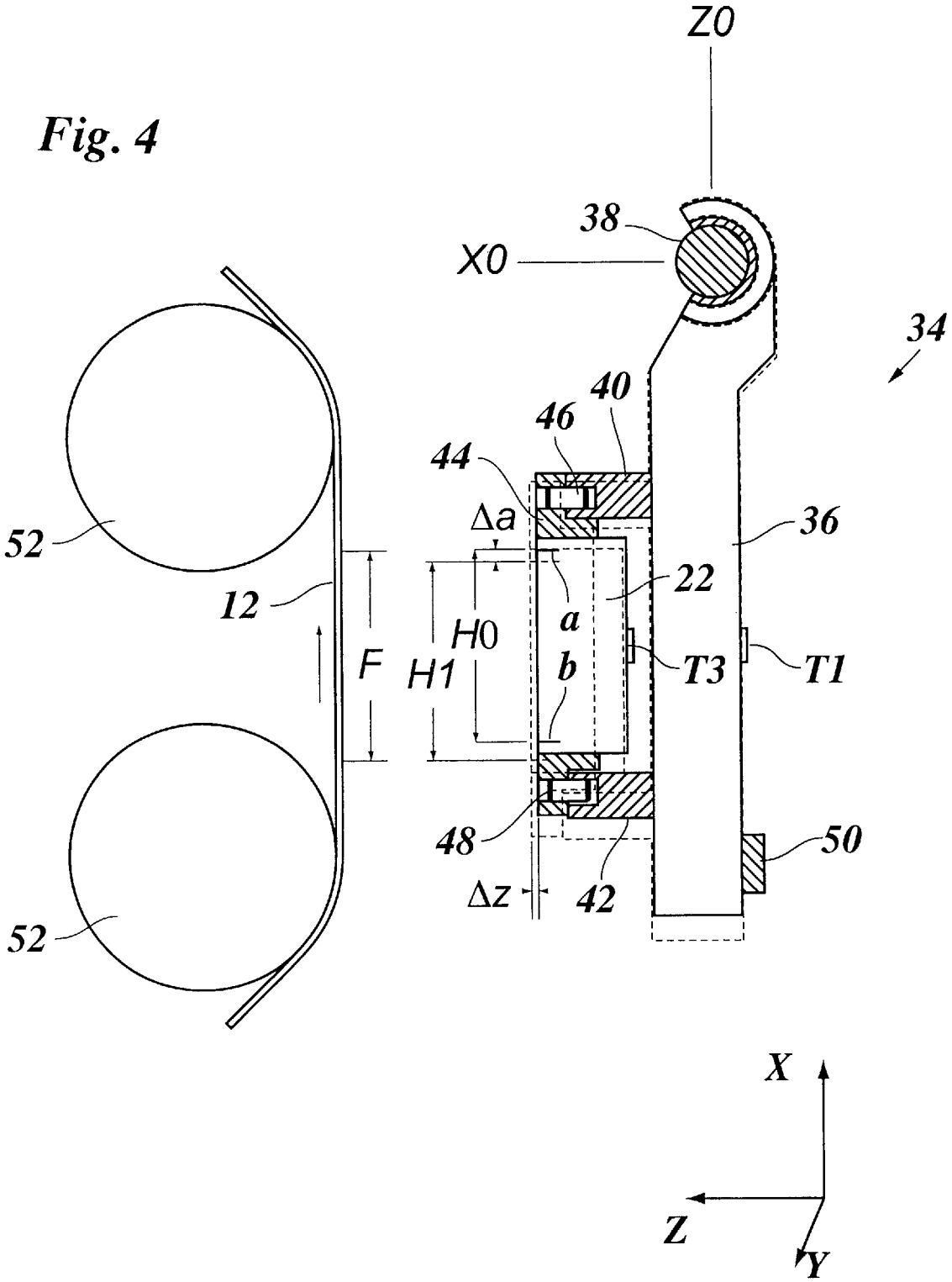
FIG. 4 is a schematic cross-sectional view of a print head according to another embodiment of the present invention.

In addition, as is shown in FIG. 4, thermal expansion of the carriage 36 in the X-direction gives rise to an offset Δa in the position of the first nozzle a in the X-direction. This offset may be ignored as long as it is constant over the printing time. However, if the temperature of the carriage 36 and hence the offset Δa are not constant, then the feed distance F should also be corrected by the difference between the current offset Δa and the previous offset that had been obtained at the beginning of the last scan pass. In general, a correction of this type will only be necessary if the printing process is interrupted for a considerable time during which the temperature of the carriage may change or if, e.g. in a plotting mode of the printer, the recording sheet 12 is fed forward and rearward in order to print multiple images that are superposed one upon the other. The offset Δa can be calculated from the known distance between the nozzle a and the reference position X0 at standard temperature, the temperature measured with the temperature sensor T1 and the thermal expansion coefficient of the carriage 36. In the embodiment shown in FIG. 4, the offsets of the nozzle arrays 22 in the main scanning direction Y may be compensated in the same manner as has been described in conjunction with FIGS. 2 and 3.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of controlling an ink jet printer containing a print head capable of undergoing thermal expansion in a sub-scanning direction (X), a main scanning direction (Y) and a direction normal to the plane of a recording medium (Z), said print head being movable relative to the recording medium in said main scanning direction (Y) and having a plurality of nozzles spaced apart from each other in said main scanning direction, said nozzles being energized at controlled timings for expelling ink droplets onto the recording medium, said method comprising measuring at least one parameter (ΔD) that is correlated to the thermal expansion of the print head, determining, for each of the nozzles, a thermally induced positional offset (Δd1 . . . Δdn) in the main scanning direction on the basis of said at least one parameter, and compensating for the offsets of the individual nozzles by controlling the timings at which the nozzles are energized.

2. The method according to claim 1, which further comprises measuring at least one parameter (ΔD) that is correlated to the thermal expansion of the print head, determining, on the basis of said at least one parameter, a thermally induced positional offset (Δz) of the nozzles in the direction (Z) orthogonal to the plane of the recording medium, which offset causes variations in the time of flight of the ink droplets from the nozzles to the recording medium, and compensating for said variations by controlling the timing at which the nozzles are energized.

3. The method according to claim 1, wherein the print head moves relative to the recording medium in the main scanning direction (Y), and a feed system is provided for moving the recording medium relative to the print head in a sub-scanning direction (X) orthogonal to said main scanning direction, such that the recording medium is fed over a controlled feed distance (F) after each scan pass of the print head in the main scanning direction, wherein the print head has a plurality of nozzles (a, b) spaced apart from each other in said sub-scanning direction (X), said method further comprising measuring at least one parameter that is correlated to the thermal expansion of the print head, determining a thermally induced positional offset (Da; H1–H0) of the nozzles in the sub-scanning direction (X) on the basis of said at least one parameter, and compensating for this offset by controlling the feed distance (F).

4. The method according to claim 1, wherein the control of the energizing timing for the nozzles is based on a measurement of a position in the main scanning direction (Y) of a fixed point on the print head, said fixed point defining a reference position (Y0), and wherein the offsets (Δd1 . . . Δdn) in the main scanning direction are determined as changes in the distances (d1 . . . dn) of the nozzles from said reference position (Y0).

5. The method according to claim 1, wherein said at least one parameter is a temperature measured at at least one point of the print head.

6. The method according to claim 5, wherein the temperatures are measured at different positions on the print head, and the step of determining the thermally induced positional offset comprises a step of deriving a temperature distribution of the print head from the measured temperatures.

7. The method according to claim 1, wherein said at least one parameter is a temperature-dependent distance (ΔD) between two fixed points of the print head.

8. An ink jet printer which comprises a print head capable of undergoing thermal expansion in a sub-scanning direction (X), a main scanning direction (Y) and a direction normal to the plane of a recording medium (Z), means for moving the print head relative to the recording medium in the main scanning direction, said print head containing a plurality of nozzles spaced apart from each other in said main scanning direction, said nozzles being energized at controlled timings for expelling ink droplets onto the recording medium, means for measuring at least one parameter that is correlated to the thermal expansion of the print head, means for determining for each nozzle a thermally induced positional offset in the main scanning direction on the basis of said at least one parameter, and a control unit for controlling the timing at which the nozzles are energized to compensate for the offsets of the individual nozzles.

9. The ink jet printer of claim 8, wherein each nozzle array has at least one row of nozzles extending in the sub-scanning direction.

10. The ink jet printer according to claim 9, wherein the carriage is guided on a guide rail which defines fixed reference positions in the sub-scanning direction and the direction normal to the plane of the recording medium.

* * * * *